US005819955A

United States Patent [19]

Clarke

[11] Patent Number: 5,819,955

[45] Date of Patent: Oct. 13, 1998

[54] HYDROCYCLONE SEPARATORS

[75] Inventor: Neville Clarke, Berwick, Australia

[73] Assignee: International Fluid Separation Pty Linited, Australia

[21] Appl. No.: 591,548

[22] PCT Filed: Aug. 8, 1994

[86] PCT No.: PCT/AU94/00456

§ 371 Date: May 17, 1996

§ 102(e) Date: May 17, 1996

[87] PCT Pub. No.: WO95/04602

PCT Pub. Date: Feb. 16, 1995

[30] Foreign Application Priority Data

Aug. 6, 1993 [AU] Australia ..... PM0395

[51] Int. Cl.[6] ..... B04C 5/04

[52] U.S. Cl. ..... 209/732

[58] Field of Search ..... 209/727, 729, 209/732

[56] References Cited

U.S. PATENT DOCUMENTS

| | | | |
|---|---|---|---|
| 2,816,658 | 12/1957 | Braun et al. | 209/732 |
| 2,975,896 | 3/1961 | Hirsch | 209/732 |
| 3,206,917 | 9/1965 | Kaiser et al. | 209/732 X |
| 3,347,372 | 10/1967 | Bouchillon | 209/727 X |
| 3,421,622 | 1/1969 | Wurtmann | 209/732 X |
| 3,471,018 | 10/1969 | Sliepcevich et al. | 209/732 X |
| 4,148,723 | 4/1979 | Mozley | 209/732 X |
| 4,235,363 | 11/1980 | Liller | 209/732 X |
| 4,581,142 | 4/1986 | Fladby et al. | 209/732 X |
| 4,737,271 | 4/1988 | Childs | 209/732 X |
| 4,855,066 | 8/1989 | Petty et al. | 209/727 X |

FOREIGN PATENT DOCUMENTS

| | | | |
|---|---|---|---|
| 18837/76 | 3/1979 | Australia . | |
| 1000113 | 2/1983 | U.S.S.R. | 209/727 |
| 86/07548 | 12/1986 | WIPO . | |
| 87/05234 | 9/1987 | WIPO . | |

*Primary Examiner*—David A. Bucci
*Attorney, Agent, or Firm*—Michael Best & Friedrich LLP

[57] ABSTRACT

A hydrocyclone separator and components for use in such separator. The hydrocyclone separator includes an axial feed inlet (1). The feed inlet (1) may further contain an outlet orifice (4) surrounded by a plurality of flexible sectors (5) which are, in turn, composed of resilient material. When relaxed, the sectors extend across a portion of the overflow outlet. The separator may include a separating chamber (14) composed of a flexible resilient material. The separating chamber may further contain riffles or grooves (13, 13*a*, 13*b*, 210).

20 Claims, 15 Drawing Sheets

HYDROCYCLONE SEPARATORS

FIELD OF THE INVENTION

This invention relates to cyclone separators, components of such separators and a method of separating components of different densities in a feedstream by use of such separators.

BACKGROUND OF THE INVENTION

A typical hydrocyclone includes an elongated conical separation chamber of circular cross-section which generally decreases in cross-sectional area from a large end to a small or apex end. An outlet for the more dense component is provided at the apex of the conical-shaped separating chamber while the less dense component of the feedstream exits through overflow outlet at the opposite end of the conical chamber.

In the prior art cyclones, the feed mixture is introduced into the separating chamber via one or more tangentially directed inlet adjacent the large end of the separating chamber. A fluid vortex is thereby created. The centrifugal forces created by the vortex throw the more dense component of the feed mixture outwardly toward the wall of the separating chamber while the less dense components are brought toward the centre of the chamber and are carried along by an inwardly located helical stream which surrounds the axially disposed "air core". The less dense components are discharged through the overflow outlet. The more dense components continue to spiral along (usually but not always down) the interior wall of the hydrocyclone and eventually exit by the underflow outlet.

Cyclone separators are used to separate a variety of materials from each other in accordance with their relative densities. For instance U.S. Pat. No. 2,377,524 references the use of cyclone separators to separate solid particles from liquids. Such separators are used in the purification of pulp during paper manufacturing. In particular, such separators are used to separate pulp from impurities such as "pitch", i.e., resinous and fatty materials, fine gritty materials and bark. During the purification of pulp, such impurities seriously hamper centrifugal separation. See further U.S. Pat. No. 4,203, 834.

U.S. Pat. No. 2,849,930 discloses the use of cyclone separators to separate gases as well as vapours from liquids. Air, carbon dioxide and water vapour often become dissolved in liquid, or partially adsorbed or occluded in fibres causing the fibres to flocculate and accumulate excessively. In addition to treating paper pulp suspensions, this patent further discloses the use of cyclone separators to remove gases and vapours and particulates from water or oil as well as ore suspensions and other liquid chemical mixtures.

Lately, cyclone separators have been used for solid/liquid separations in the mining and chemical processing industries as well as in sewage treatment plants.

Cyclone separators are further widely used in the separation of oil and water. One example of a cyclone with parameters for separating oil and water is found in U.S. Pat. No. 4,964,994. Other examples of liquid/liquid separators designed for separating oil and water are found in U.S. Pat. Nos. 4,237,006, 4,576,724, 4,721,565, 4,749,490, 4,876, 016, 5,009,785 and 5,194,150.

Typically in such cyclone separators, the mixture to be separated is tangentially introduced into the tapered chamber at high velocity through a side or tangential entry feed inlet. Centrifugal forces are produced which separate the components by their density. The less dense material is concentrated in a core along the axis of the chamber and the heavier or more dense material is concentrated toward the outer wall. Generally, the lighter material is removed through the overflow outlet at the larger end of the chamber. The heavier material is removed through an underflow outlet at the smaller end.

Commercial cyclones while performing well under laboratory conditions often fail to perform satisfactorily in field conditions. For example, when used in oil fields and sewage treatment plants, numerous materials such as sand, scale, iron sulfide deposits, fibres, timber and paper pulp, plastic and rubber particles may clog the tangential inlets, overflow outlets, and underflow outlets.

In addition, the high velocity of the liquid due to the side entry feed inlet often creates a turbulence which extends throughout the entire cross-section of the chamber near the inlet, producing instability in the core of lighter material and reducing the efficiency with which this material is collected at the overflow outlet.

Further difficulties with the cyclone separators of the prior art have been seen in the oil industry where space limitations and weight carrying capacities of offshore platforms govern the number and size of separators. The metallic cyclones of the prior art occupy a very substantial amount of floor space. In such industries, the need exists to install the maximum number of cyclones in the smallest area. Further, during adverse conditions, maintenance of the cyclones is often proven difficult by the limited working area. In addition, such prior art cyclones present a safety hazard for maintenance personnel.

Accordingly, it is an object of the present invention to provide a hydrocyclone apparatus which overcomes at least some of the drawbacks and disadvantages of the prior an as discussed above while providing for increased separation efficiency.

SUMMARY OF THE INVENTION

There is provided a hydrocyclone axial feed inlet body comprising:

a body having an upper face, a lower face and a circumferential edge;

the body having formed in it at least one helical duct;

each duct extending about the body by less than 360°;

an overflow orifice extending through the body along a central longitudinal axis.

There is also provided a hydrocyclone separator body comprising a hollow tapered form having an inlet end and an apex end which is smaller than the inlet end, the body being fabricated from a flexible polymer.

There is additionally provided a hydrocyclone separator body comprising:

a hollow tapered form having an inlet end, an apex end and an interior surface;

the interior surface having formed therein one or more circumferential grooves or riffles.

DETAILED DESCRIPTION OF THE INVENTION

Figure 1:
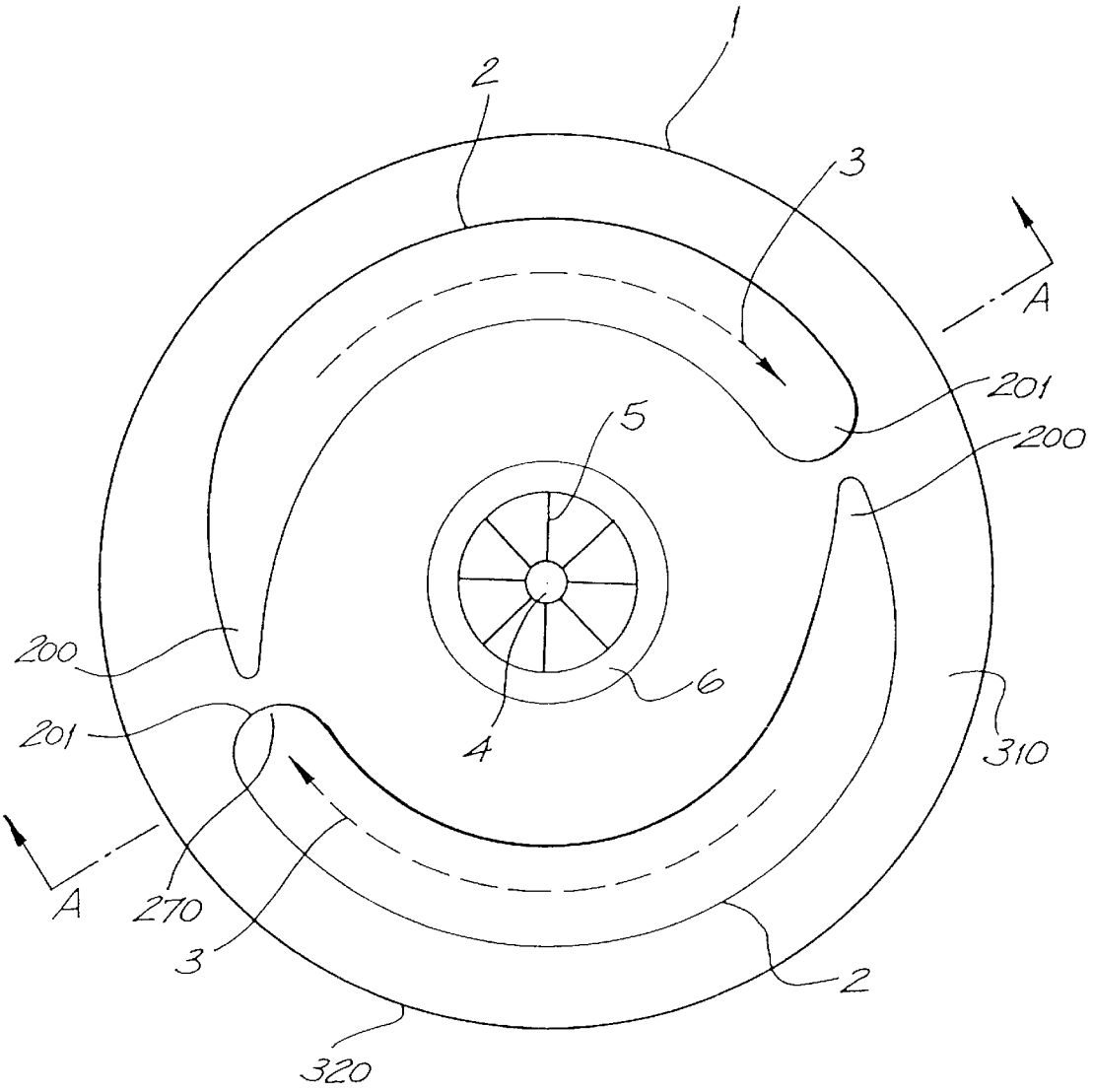
FIG. 1 is a top view of a feed inlet device.
Figure 2:
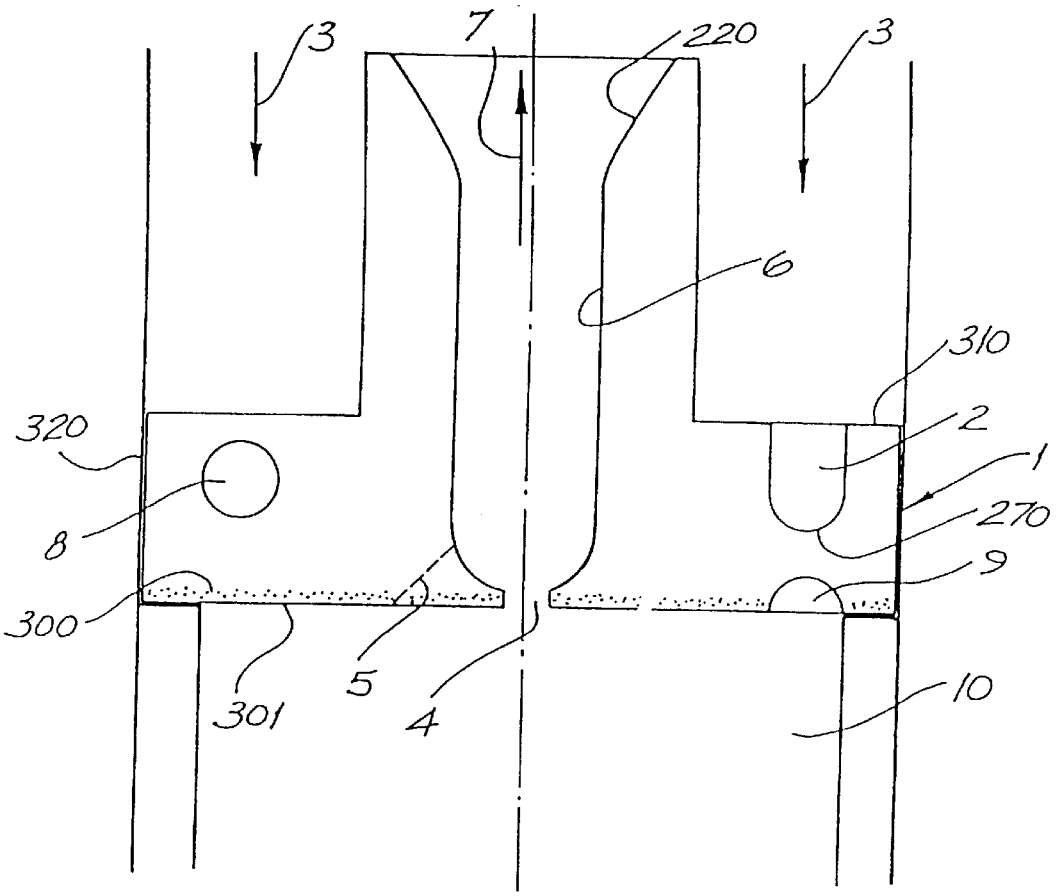
FIG. 2 is a cross-sectional view along line A—A of the feed inlet.

Referring now to the feed inlet referenced in FIGS. 1 and 2, the feed inlet body 1 is characterised by a bottom surface, a circumferential edge 320 and at least one crescent-shaped external passageway 2 on the top surface 310. Preferably, the inlet contains more than one passageway of equivalent dimnensions. The duct extends around the feed inlet body by less than 360°. In this example each passageway 2 approximates one-half of the perimeter of the uppermost portion of the feed inlet. The passageways 2 are spaced apart by 180°. The direction of fluid entry is demonstrated by the arrow 3. The depth of the passageway increases from the distal end 200 to the proximal end 201. At the proximal end 201, the bottom of the passageway 270 is coincident with the bottom of the round opening into the inlet duct 8 as shown in FIG. 2. At the distal end 200 the depth of the passageway 2 is near zero. In this example the depth tapers linearly from the proximal to the distal end.

Figure 16:
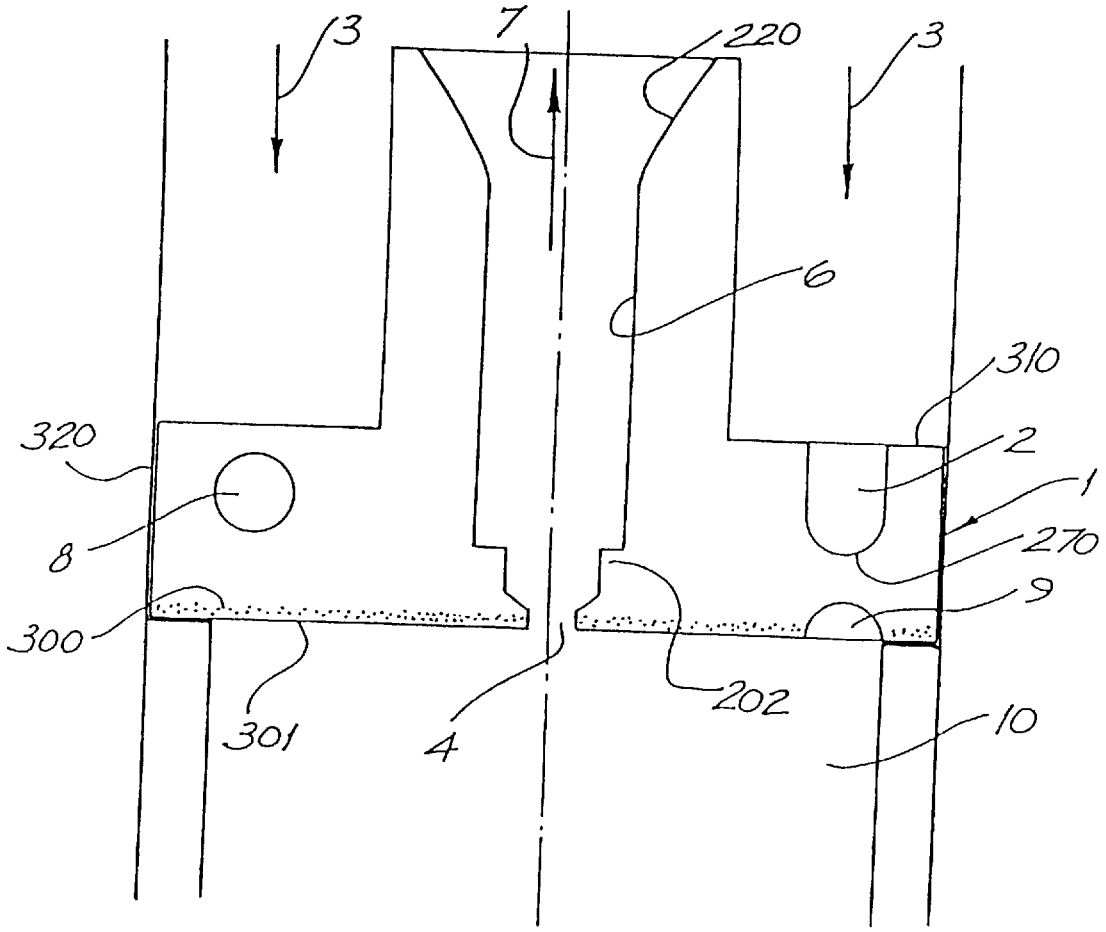
FIG. 16 is a view similar to FIG. 2 showing an alternative construction.

The central overflow orifice 4 is surrounded by a plurality of flexible sectors. The lighter component of the feedstream exits the overflow orifice 4 into conduit 6. In preferred embodiments, the diameter of the conduit 6 is greater than the diameter of the orifice 4. The transition from the smaller diameter of the orifice 4 to the larger diameter of the conduit 6 may be accomplished in a variety of ways. As shown in FIG. 2 the transition may be accomplished by a simple blend, radius or taper. As shown in FIG. 16, the transition may also incorporate a boss, shelf or step 202. The boss, shelf or step facilitates the opening of the orifice 4, particularly the unobstructed opening of the orifice, when a tapered rod is inserted down the conduit 6 for unblocking purposes as described, for example, with reference to FIG. 7. The shelf, boss or shoulder 202 allows the tapered rod to expand the lower portion of the conduit 6 including the orifice 4 without the need to directly contact the walls of the orifice 4.

FIG. 2, a cross-sectional view along line A—A of FIG. 1, demonstrates the exit pathway of the lighter component from the overflow orifice. Flow of the feedstream into passageway 2 continues into inner helical duct 8. From inner duct 8, the feedstream enters into the top portion of the separating chamber 10 via swirl exit path 9 located on the bottommost surface of the feed inlet. The less dense component exits the separating chamber at the overflow orifice 4 as overflow fluid 7 through conduit 6. Note that the upper extremity of the conduit 6 includes an expanding taper or pilot opening 220 which facilitates mating the inlet 1 with a collection tube 6a (see FIGS. 6 and 7).

Figure 3:
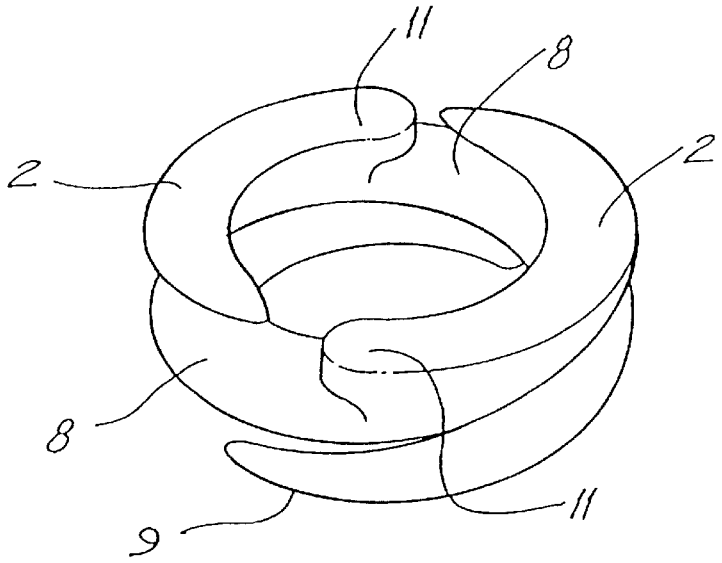
FIG. 3 is an isometric view of the helical inner duct of the feed inlet and demonstrates the pathway of the feedstream through the duct.

FIG. 3 shows the boundaries of the spiral path of the feedstream as confined by the crescent-shaped passageway 2 through the inner helical duct 8 and crescent shaped exit passage 9. The "sweep" of each duct in this example is one quarter of a revolution. Shorter ducts would involve even lower frictional losses. The sweep of the duct is defined as the extent of the fluid passage through the inlet 1 which is completely surrounded by the inlet material. Note that in this example the exit opening and inlet opening of the duct 8 are at about the same radius.

The cross-sectional shape of the helical duct 8 demonstrated in FIG. 3 is circular and uniform. The diameter of the helical duct is dependent on the desired inlet flow as well as the chemical constituency of the feedstream. A rectangular duct is also feasible. A height to width ratio of 1:2 is preferred in a rectangular duct.

To remove grease from water in sewage, a 10 mm duct diameter is preferred for a 100 liter/min. flow; to remove oil from water, a 13 mm duct diameter is preferred for a 100 liter/min. flow; and to remove light oils from oranges a smaller diameter, eg., 9 mm duct diameter for a 100 liter/min., is preferred. The feedstream exists the inner helical duct and enters the separating chamber 10 (of FIG. 2) through the crescent-shaped swirl exit 9.

Figure 4:
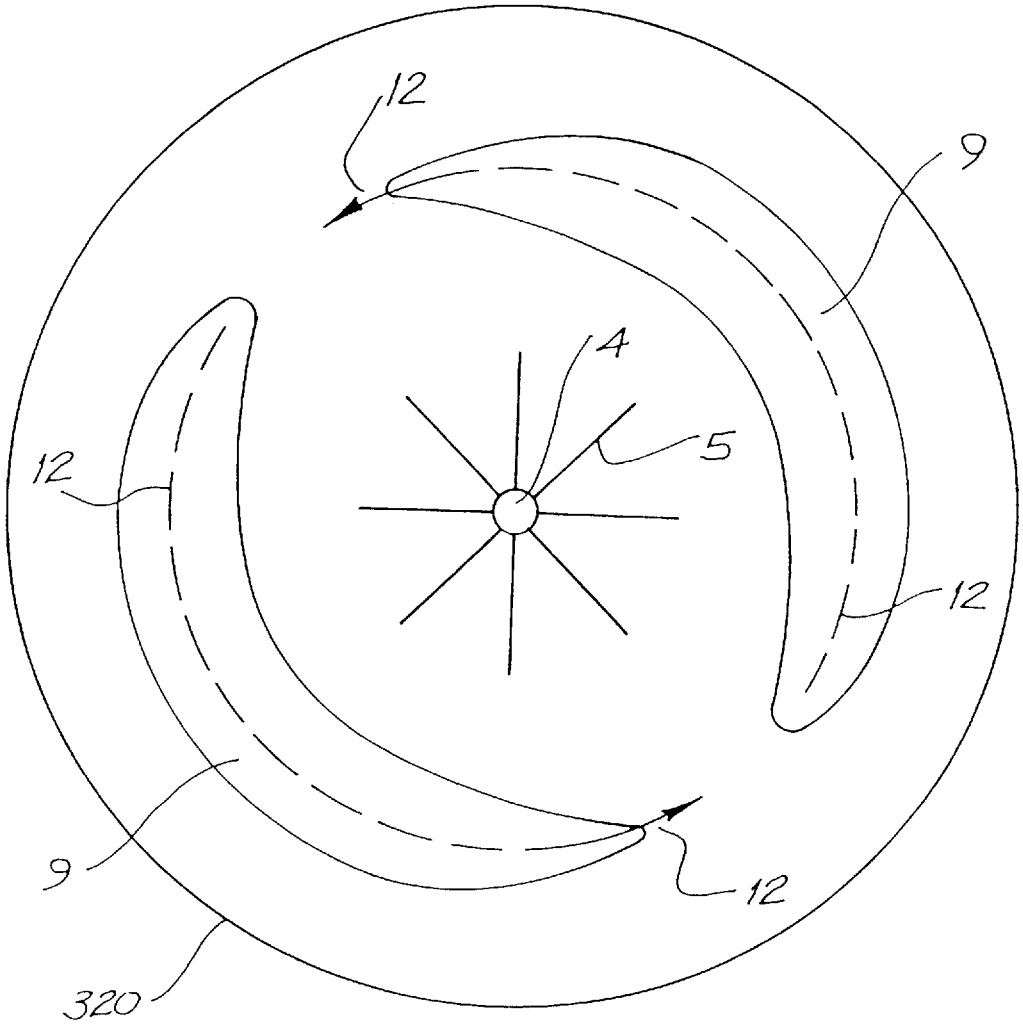
FIG. 4 is a bottom view of a feed inlet device.
Figure 11:
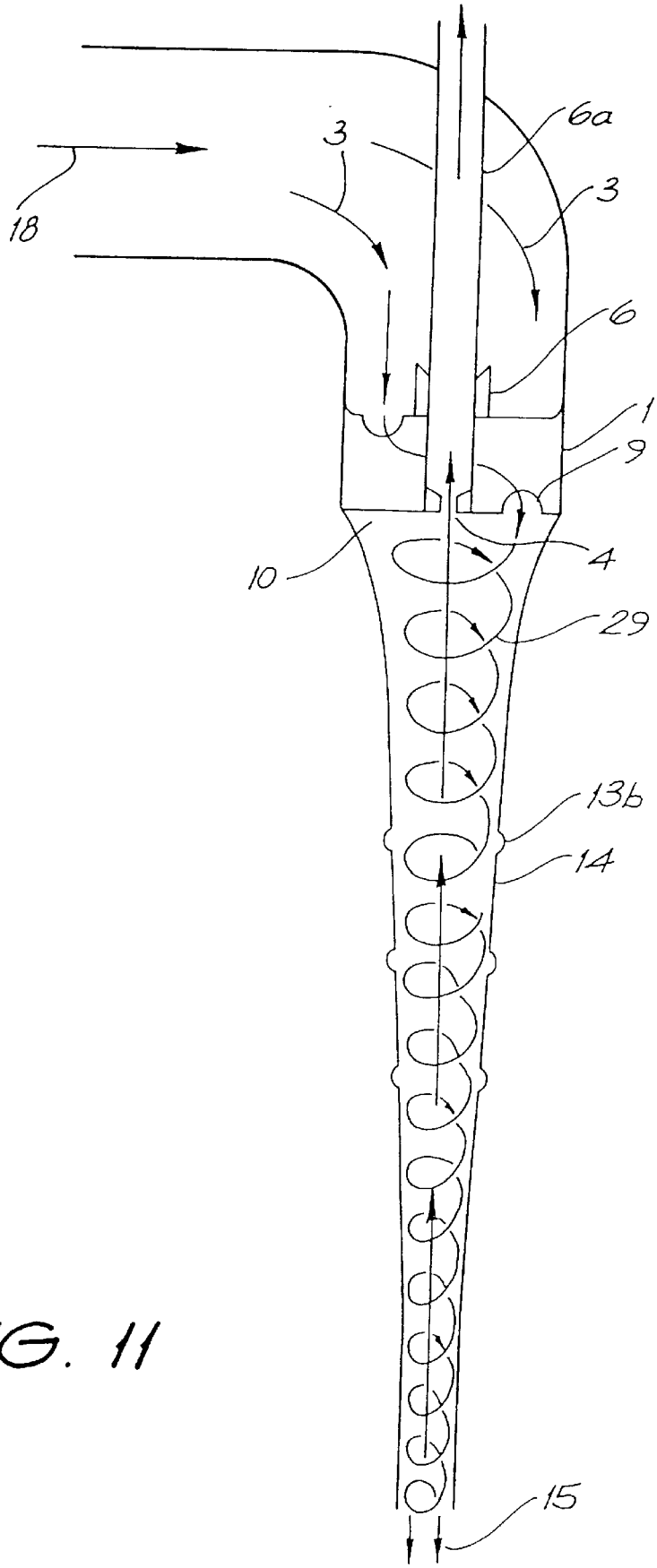
FIG. 11 is a schematic view of a hydrocyclone.

FIG. 4 is a bottom view of the feed inlet. Preferably, the feed inlet device 1 includes swirl exit path 9, as depicted in FIG. 4, which is preferably of crescent shape. In plan view the crescent is tapered at each end. The medial axis 12 of each crescent is generally concentric with the discharge opening 4. These exits 9 feed into the top portion of the separating chamber where each duct terminates. The inner helical duct converts the axial motion of the feedstream motion into tangential motion. This is depicted in FIG. 11. As suggested in FIG. 11, a vortex 29 is facilitated in the separating chamber 10 by the inlet 1. The heavier material descends the separating chamber by means of the vortex and exist the chamber through the underflow outlet 15. The lighter material ascends the separating chamber within the central core of the vortex 29 and exists the separating chamber through overflow outlet 4. It then continues out of the hydrocyclone through conduits 6 and exit tube 6*a*.

A separating chamber may be fabricated from a metal or a more flexible material such as a polymer as described herein. The separating chamber may consist of a conventional cyclone shape including but not limited to, those described in U.S. Pat. Nos. 2,377,524; 2,849,930; 4,203,834; 4,237,006; and 4,964,994 which are hereby incorporated by reference. Ideally for liquid-liquid separation, a logarithmic shape as depicted in U.S. Pat. No. 2,849,930 (FIG. 9) is preferred.

Figure 5:
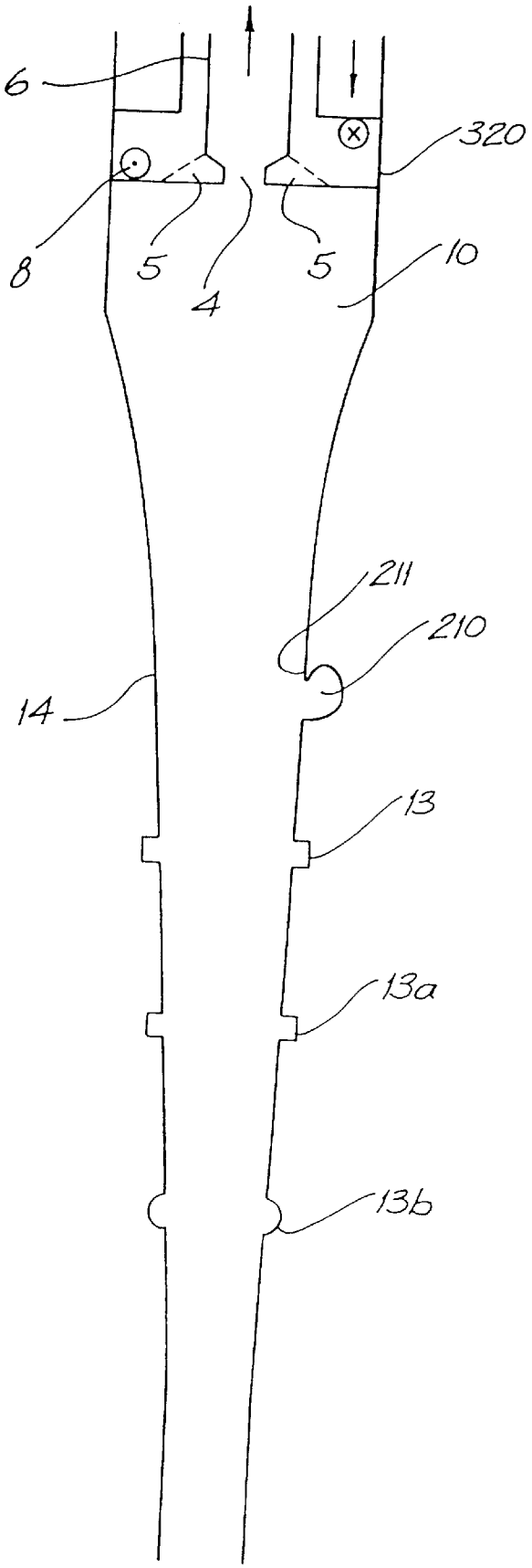
FIG. 5 is a schematic cross-section of the interior of a cyclone body and demonstrates the recessed chambers.

As shown in FIG. 5 of the present disclosure, a cyclone body 14 may optionally include circumferential grooves or riffles 13 formed in the interior surface. There are no limits to the number of grooves which may be used. The grooves or riffles may be in many geometric forms. Suitable designs include a square 13*a* or semi-circle 13*b* as well as rectangular or any combination of such designs. A riffle or groove 210 with an overhang 211 has also been demonstrated as effective. An oil film travelling down the body 14 is encouraged to depart the interior surface of the body by the overhang 211. Such grooves may be used in the conventional metallic separating chamber of the prior art as well as the flexible separating chambers as set forth herein. The grooves or riffles are for example, 3 mm wide and 3 mm deep.

Figure 6:
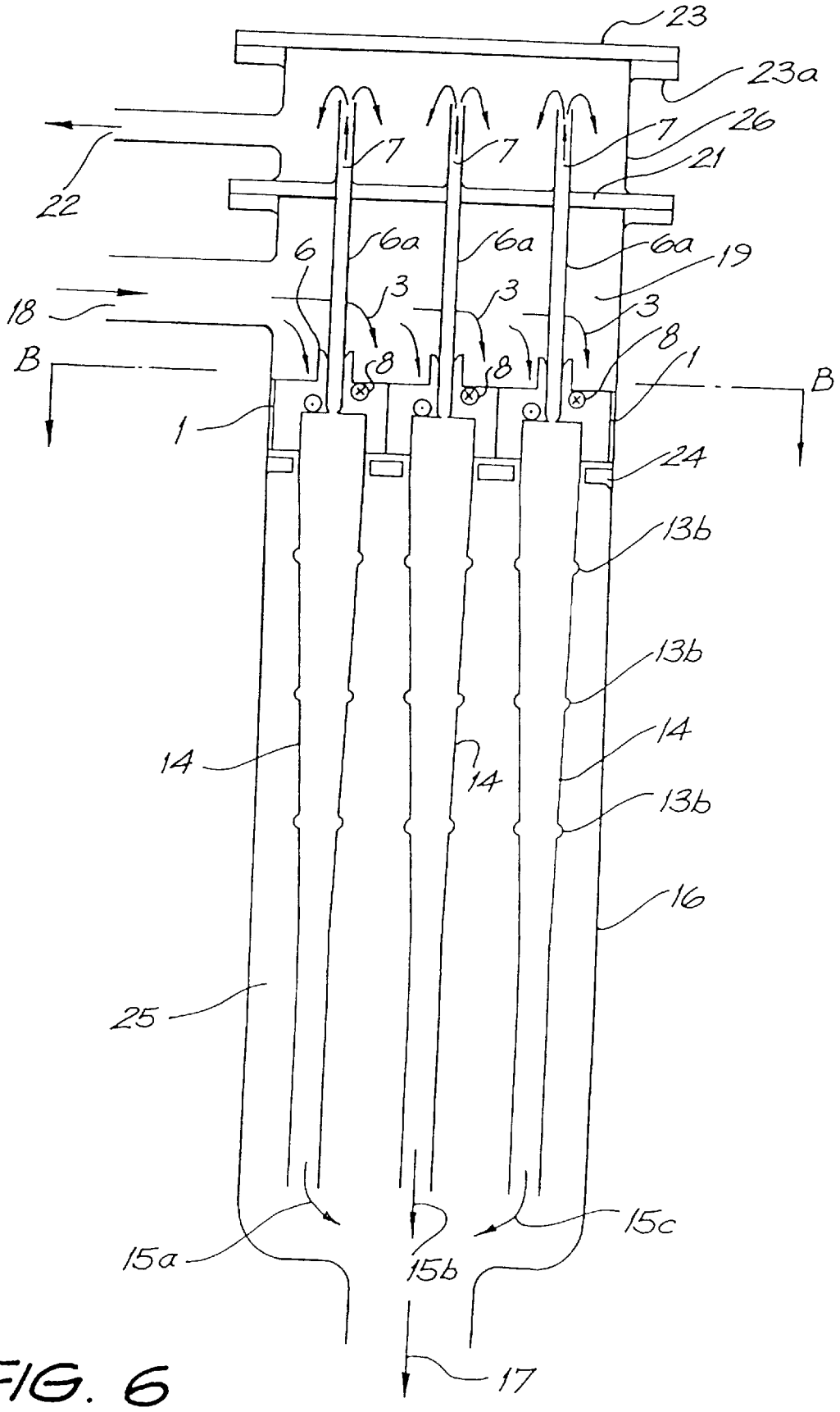
FIG. 6 is a schematic cross-sectional view through line C—C of FIG. 9 of a pressure vessel containing a multitude of hydrocyclone separators.

The feed inlet of this invention may be used in combination with the cyclone body as depicted in FIG. 6. In the alternative, any conventional feed inlet device such as those set forth in U.S. Pat. Nos. 2,849,930; 4,163,719; 4,237,006; and 4,983,283 of this invention may be used in combination with the separating chamber with riffles or grooves set forth in FIG. 5. In FIG. 5, the cyclone by 14 may be used with the in-line swirl generator 1 set forth herein.

FIG. 6 is a cross-sectional view of multiple cyclones in a pressure vessel 16. The multiple cyclone bodies reside in a collective underflow discharge chamber 25. The heavier component in the feedstream exists the underflow discharge chamber through common or collective underflow outlet 17. The total effluent exiting at 17 is the combination of discharge effluents at 15*a*, 15*b* and 15*c*. The common entry port 18 carries the feedstream into the distribution chamber 19 of the pressurised vessel at sufficiently low velocity to minimise shearing of the feedstream. Normally, the feedstream, if close to the viscosity of water, is introduced into the hydrocyclone via common entry port 18 at a velocity less than 2 ft./sec. The feedstream then flows into the individual feed inlets 3 of the cyclone separators. Each of the respective streams of overflow fluid 7 flow via conduit 6, through a collection tube 6*a* into a common overflow fluid chamber 20. This chamber is confined by casing 26. Chamber 20 is separated from chamber 19 by dividing plate 21, such as a flange which is bolted to flange 21*a* and integrally supports a collection tube 6*a* which may be affixed to flange 21. Normally, chamber 20 is maintained at atmospheric pressure. Chamber 19 normally operates at a pressure which is higher than the pressure in the underflow discharge chamber 25. The operating differential pressure between chamber 19 and chamber 25 is between 20 and 200 psi, preferably between 50 and 150, most preferably around 100 psi. The differential pressure between the distribution chamber 19 and the underflow discharge chamber 25 is such that the cyclone body 14 of separating chamber 10 is forced downward in the direction of the underflow discharge chamber and therefor energised or compressed against dividing or support plate. 24. The use of higher pressure in chamber 19 versus chamber 25 wherein the cyclone body 14 is composed of a flexible material forces the cyclone bodies against dividing plate 24 thus affecting a seal. Therefore, it is unnecessary to use O-rings in the apparatus when the cyclone by is composed of flexible material.

Figure 10:
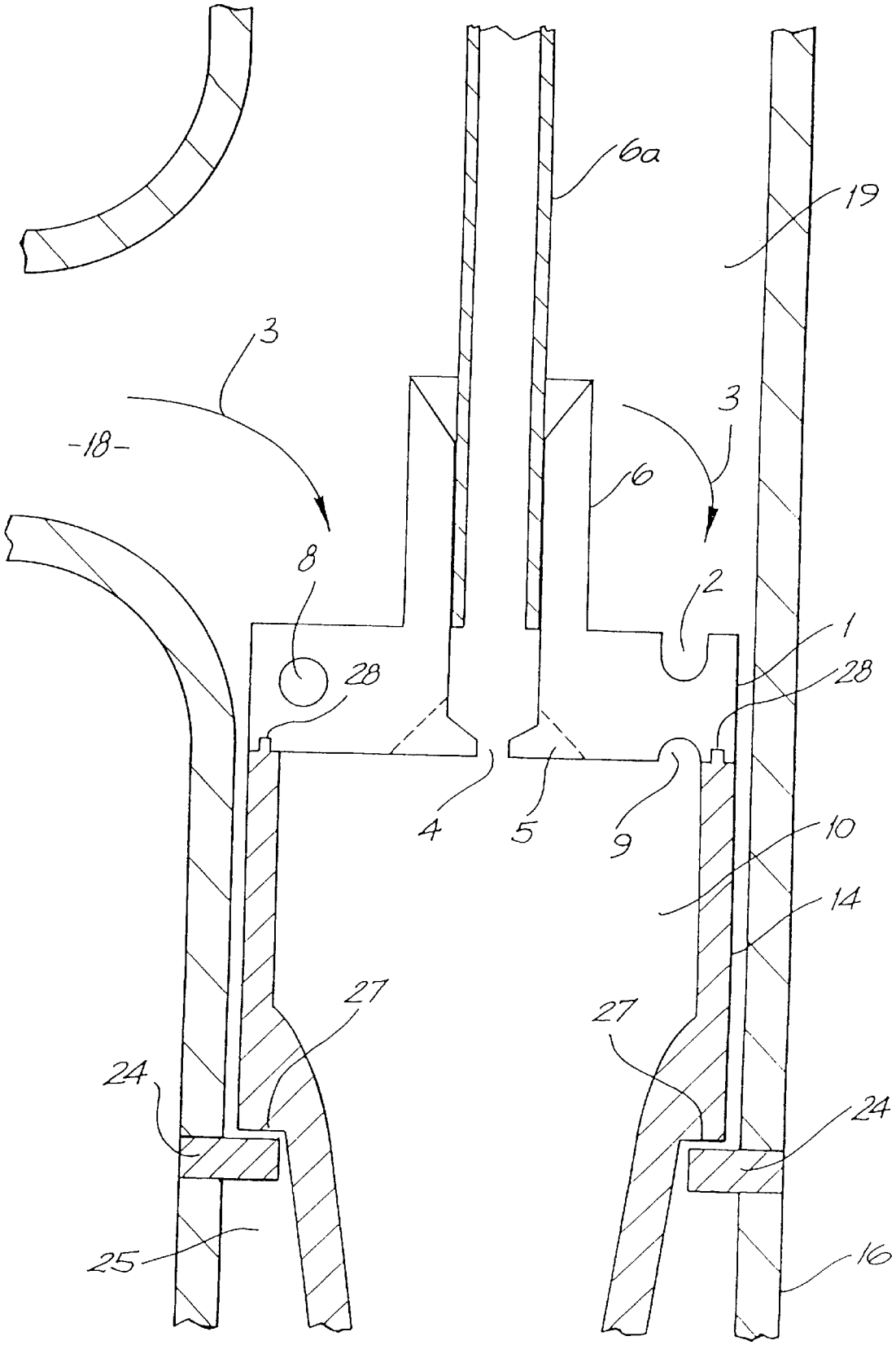
FIG. 10 is a schematic cross-section of the feed inlet and the top of the separating chamber used in accordance with this invention.

As set forth in FIG. 10, a preferred embodiment of this invention is one wherein the separating body 14 is characterised by a perimetral shelf 27 which is extended horizontally and complements dividing plate 24. Thus, shelf 27 provides a support and a sealing face for the cyclone. When force is applied downward onto the separating chamber, shelf 27 is energised or compressed and seals itself into dividing plate 24. This is especially true when the feed inlet is composed of a polymer such as urethane. Where a flexible material is not used for the separating chamber, a resilient material such an O-ring or rubber gasket may be inserted between shelf 27 and dividing plate 24.

Likewise, when either or both of the feed inlet 1 and separating chamber 10 are composed of flexible material, the differential pressure between the two causes sealing to occur at cojoining interface 28. In another mode, the feed inlet 1 and cyclone body 14 are joined together, either by welding or gluing. Alternatively, if both surfaces are not composed of a flexible material, a resilient material such as an O-ring or rubber gasket should be inserted at interface 28.

In addition, FIG. 10 exemplifies the seal between collection tube 6*a* and conduit 6 to be effected by a tight (interference) fit between them when conduit 6 is composed of a flexible material. No. O-ring is therefore needed. When conduit 6 is not composed of a flexible material, a looser (sliding) fit between conduits 6 and 6*a* is required. An O-ring or gasket is then further required as sealant.

From the overhead fluid chamber 20 in FIG. 6, the lighter component exits through common exit port 22 where it is collected. Where the operation involves hazardous materials, such as when used to separate oil from water on offshore platforms, the end cap 23 seals off the chamber 20 from the operator. End cap 23 is bolted to flange 23*a* which is an integral part of common overflow fluid chamber 20. The unit may be run under certain operating conditions with end cap 23 removed. For example, when the unit is being used in effluent and sewage treatment applications, flange 23 may be removed. Observation can then be made by the operator as to the flow activity of overflow 7 for each cyclone. The operator of the unit will readily ascertain if a cyclone has been partially blocked or totally blocked. In such applications, it is essential that the height of conduit 6*a* is extended past the height of the exit port 22. The height differential permits the operator to view the fountain-like exit of the effluent from the conduit 6*a*.

As depicted in FIG. 6, the pressurised hydrocyclone casing used in this invention consists of a pressure vessel comprising two or three sections which may be separated from each other. The first section (when it is employed) is represented by end plate 23. The second section consisting of common overflow fluid chamber 20, dividing plate 21, conduit 6*a* and flange 23 are generally welded together. The third section consists of distribution chamber 19, and underflow discharge chamber 25 separated by a dividing plate 24.

Where a conventional feed inlet containing a traditional non-flexible overflow orifice is used, and partial or total blockage at the overflow orifice results or occurs, the apparatus is deblocked by applying pressure at exit port 22 such that fluid flow passes in the opposite direction through the overflow orifice. In such circumstances, the apparatus requires the use of end cap 23.

Unfortunately, attempts to deblock by the use of pressure may compound the blockage. In such an event, the cyclone separator must be shut down and be dismantled and serviced. In most circumstances, the use of an overflow orifice having flexible sectors 5 enlarges the orifice when pressure is applied and thus large obstructions are able to be cleared.

Figure 7:
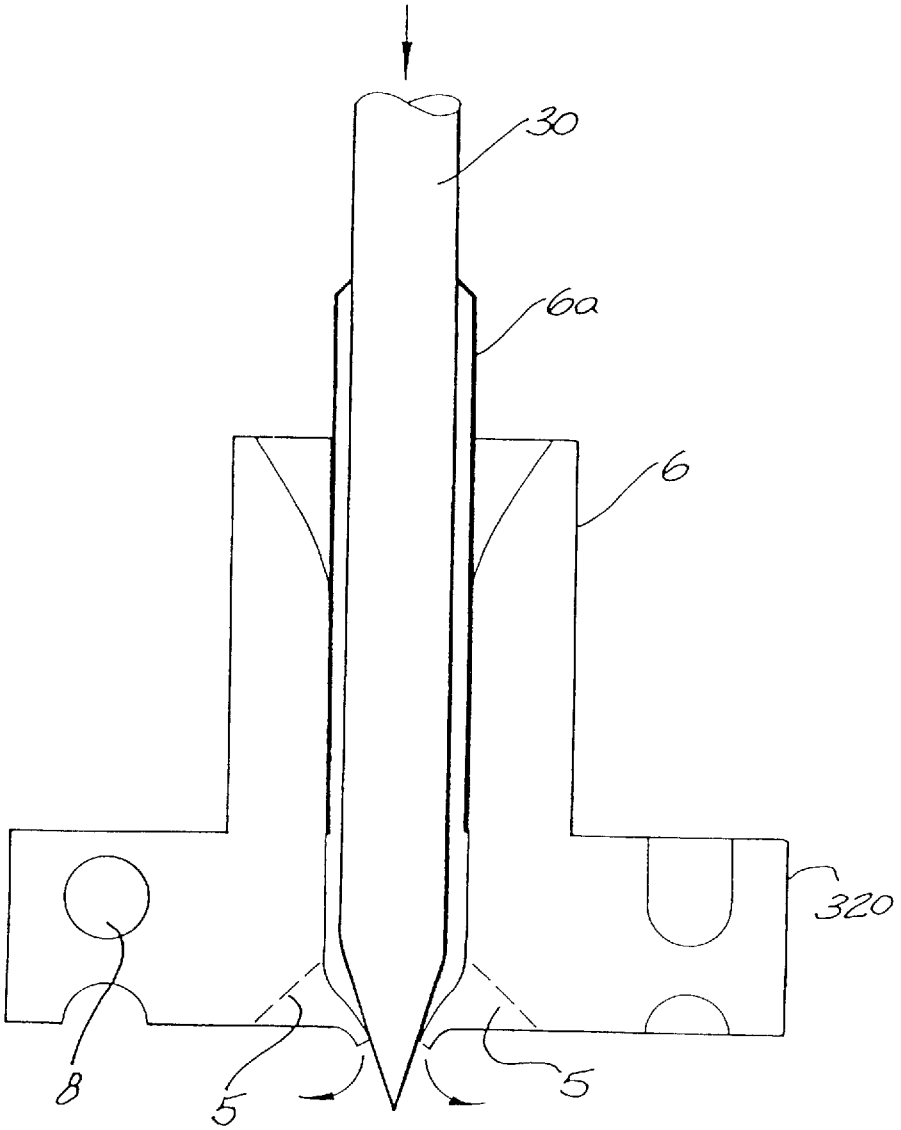
FIG. 7 is a schematic cross-sectional view demonstrating the use of a deblocking rod with an overflow orifice which employs flexible sectors.

The use of the overflow orifice with flexible sectors 5 in accordance with this invention permits deblocking of the orifice without major disruption of the operation of the cyclone separator. As depicted in FIG. 7, deblocking rod 30 with tapered tip may be inserted down through the tube 6*a* and conduit 6 causing the orifice to open and be cleared of all obstruction. This enlargement is attributed to the deflection of the flexible sectors. Naturally when the feedstream involves hazardous material, the unit will have to be shut down and the end cap 23 removed.

Figure 12:
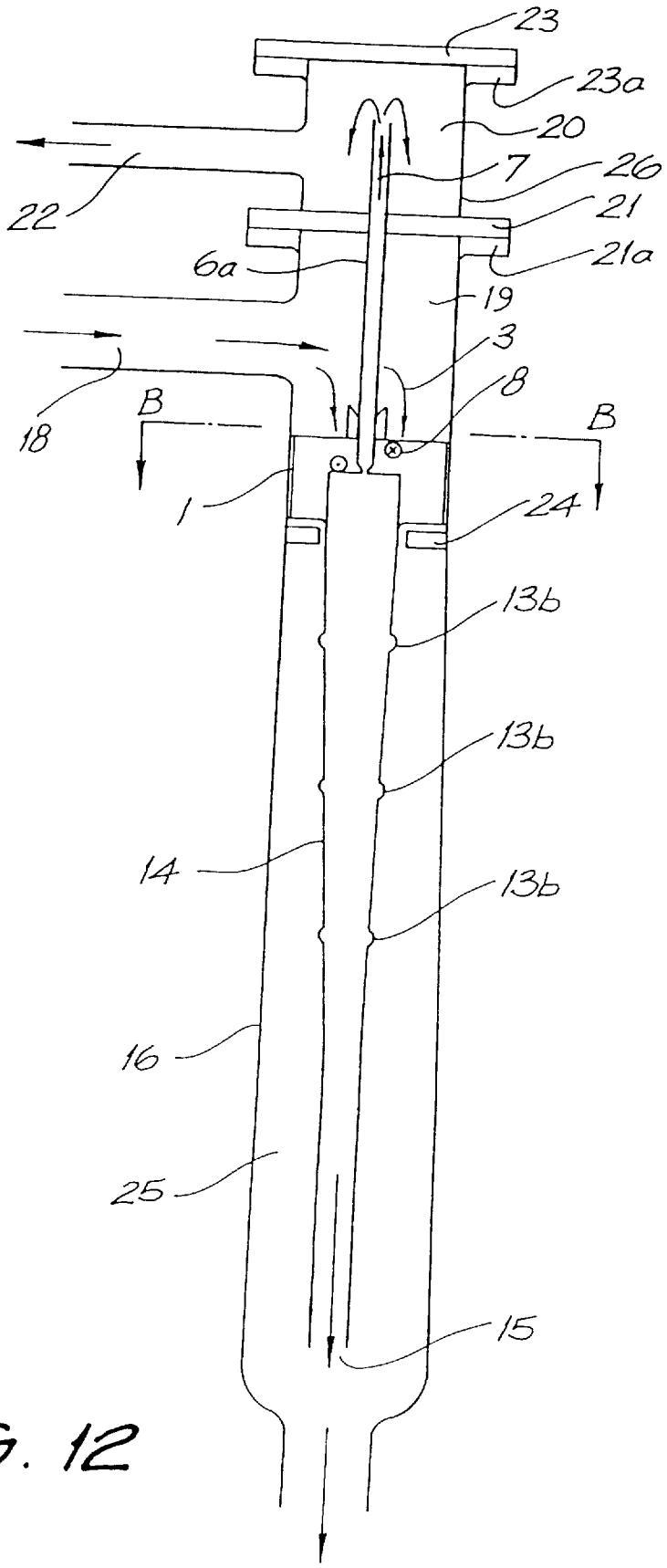
FIG. 12 is a schematic cross-sectional view of a pressurised vessel containing a single hydrocyclone separator.

While the above description has been focused on multiple cyclones in a pressure vessel, it will be readily appreciated that the description is equally applicable to single cyclones in pressurised vessels. FIG. 12 illustrates a pressurised vessel containing a single cyclone.

Figure 8:
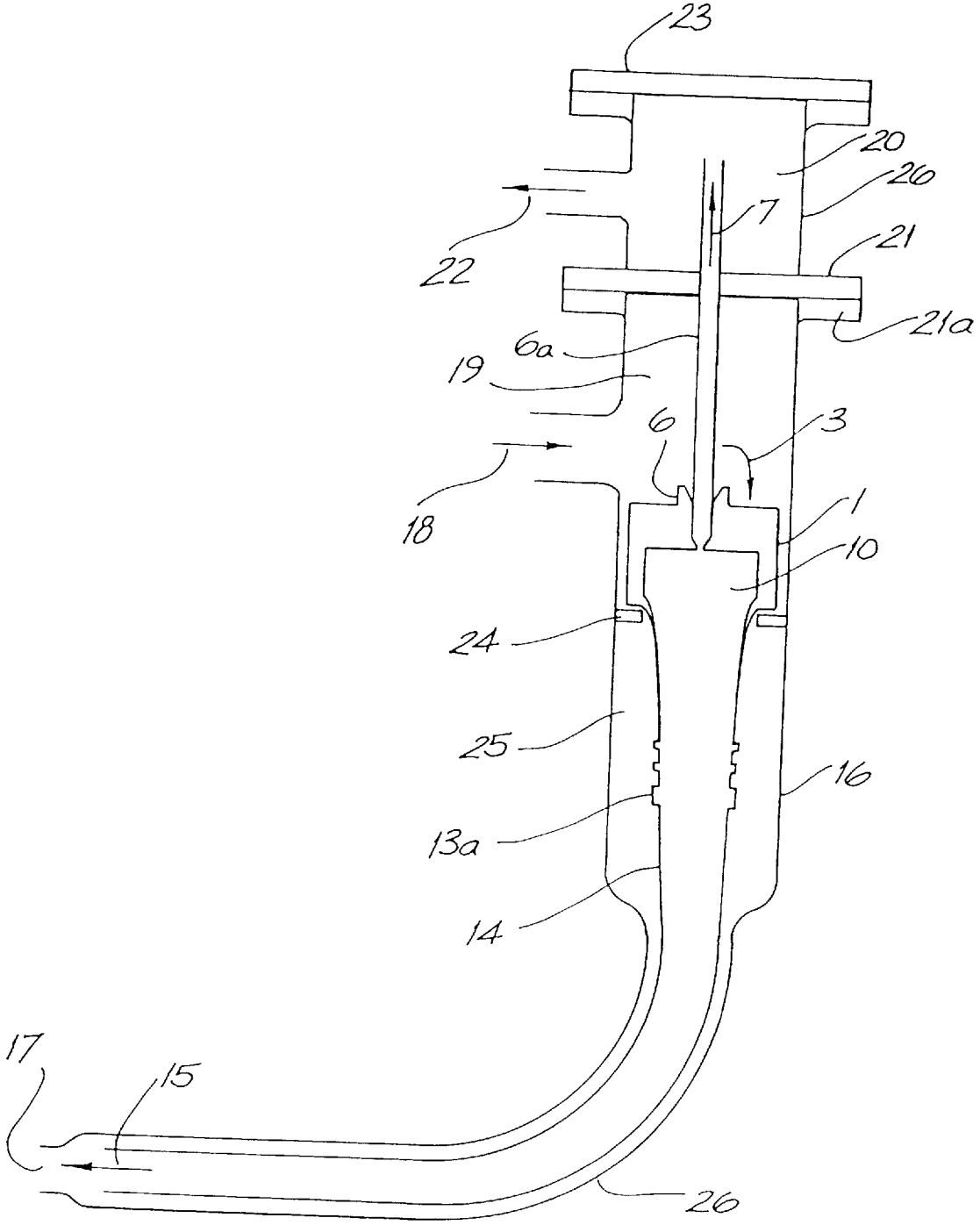
FIG. 8 is a schematic cross-sectional view of the interior of a single cyclone member wherein the separating chamber is composed of a flexible material.

FIG. 8 depicts a single hydrocyclone within a curved pressurised vessel 16. The cyclone body 14 is composed of a flexible material. It will further be readily appreciated that such flexible material may be used to fabricate the separating chambers of multiple cyclones.

The use of flexible materials, such as polyurethane, synthetic rubbers, structural nylons, etc., to fabricate the separating chambers and inlet is highly advantageous in those industries wherein access to the unit requires minimum headspace for servicing. For servicing, the casing 26 of the common overflow fluid chamber (20) must first be removed. This includes separation of dividing plate 21 from flange 21*a* along with conduit 6*a*. The feed inlet 1 and separating chamber 14 may then be removed. Due to the flexible nature of the separating chamber, clearance equal to the length of the cyclone body is not longer required. In practice, a clearance less than one-third of the length of the cyclone body is actually needed.

Figure 9:
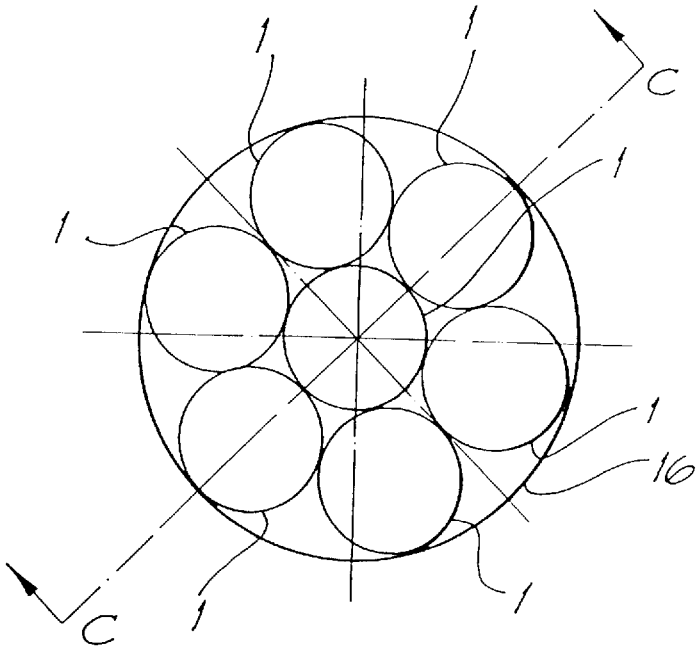
FIG. 9 is an end view of a hydrocyclone pressurised vessel taken along the line B—B in FIG. 6 illustrating the density packaging of seven hydrocyclones in one pressure vessel.

The use of the feed inlet 1 of this invention further allows for a greater density of cyclones per pressure vessel. As seen in FIG. 9, the cyclones are arranged in a "cable" or closest packing layout which provides the greatest number of the cyclones in a cylindrical space. Because of the axial geometry of the feed inlets and separating chambers, FIG. 9 illustrates that the number of cyclones in a single vessel can be maximised by use of the axial feed inlets of this invention. This axial arrangement minimises turbulence, lateral stress on the separator bodies and also insures even flow distribution to each of the respective cyclones. By the use of an axial flow entry versus side entry as depicted in U.S. Pat. No. 5,194,150, the density of the cyclones within the pressure vessel is increased and the ability to treat and separate fluids is greater than the prior art. As a result, for any given size pressure vessel, by means of the instant feed inlet, a greater amount of feedstream may be treated for the same capital investment.

Figure 13:
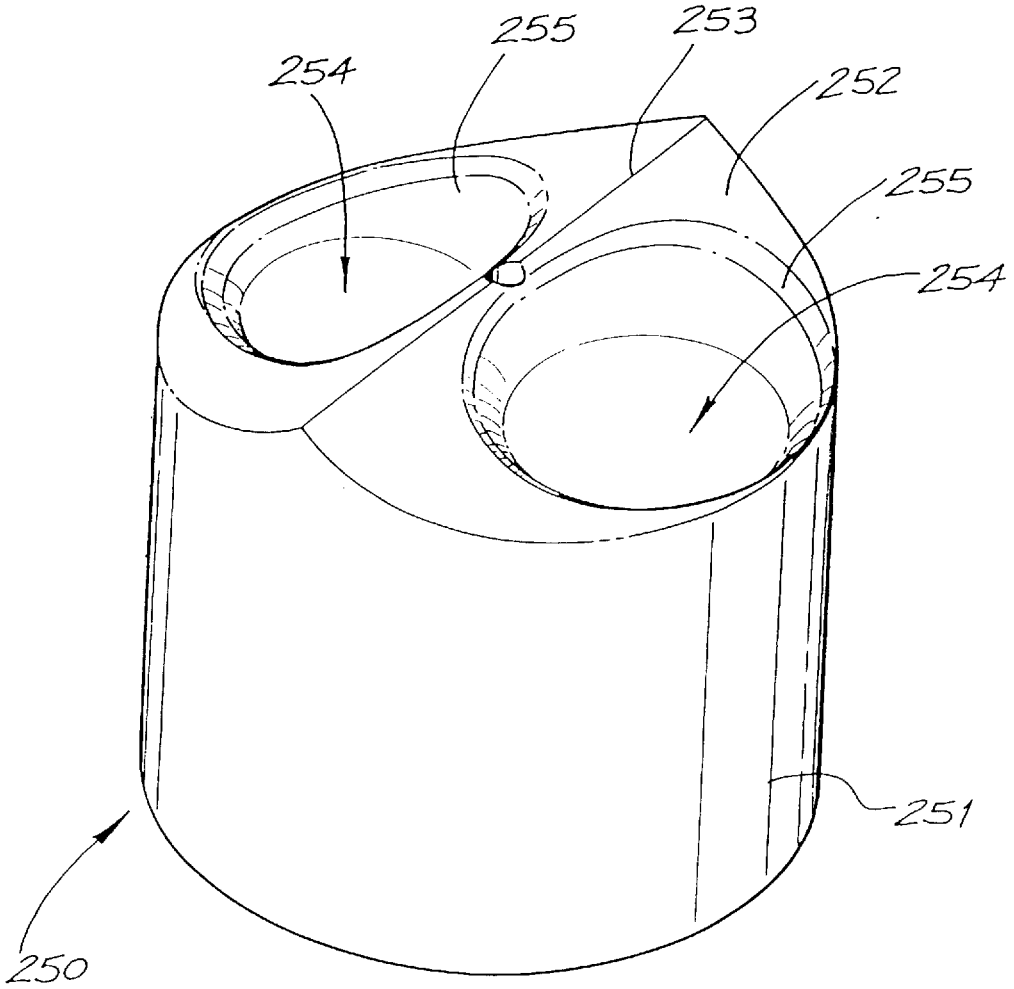
FIG. 13 is a perspective view of an alternate inlet.

As shown in FIG. 13 an alternate axial flow nozzle structure 250 comprises a generally cylindrical body 251. The uppermost surface 252 (the one closest to the incoming flow) is subdivided by a central ridge 253. A tapering duct 254 is located on either side of the central ridge 253. A gentle blend 255 leads into each duct 254.

Figure 14:
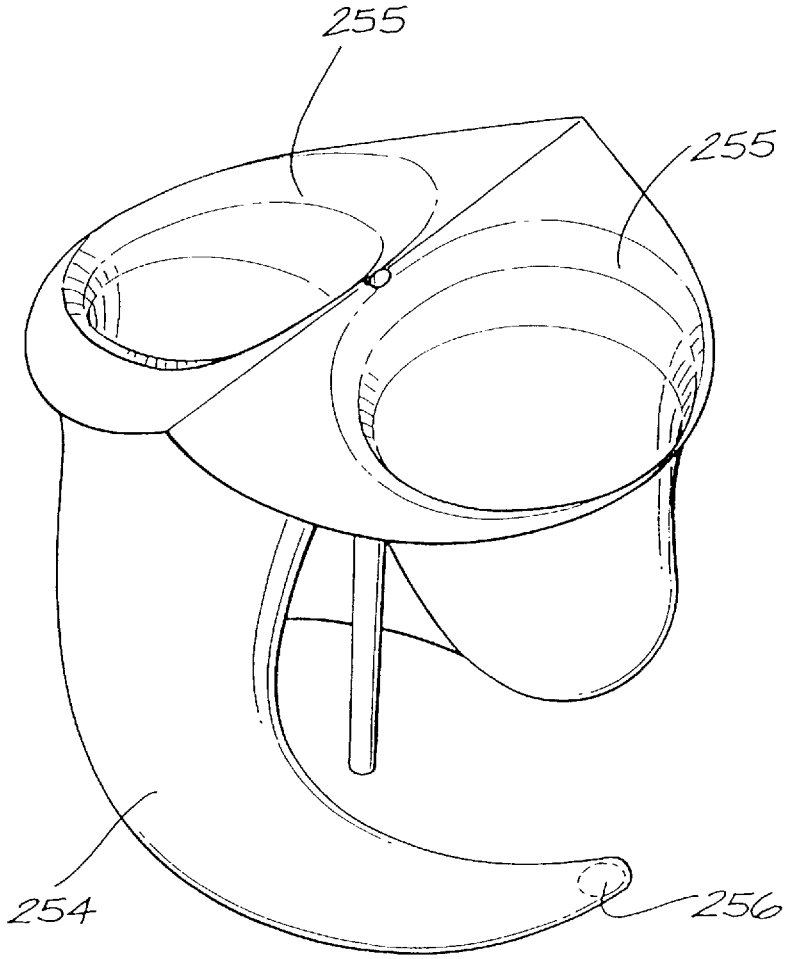
FIG. 14 is a perspective view of the duct within the inlet, also showing the overflow conduit.

As shown in FIG. 14, each duct 254 continues from the blend area 255 toward an outlet opening 256 formed on a lower surface of the inlet 250. In one preferred embodiment, the taper angle of each duct 254 is 6°–8°. The bend of the duct 254 is calculated to keep the acceleration of the fluid within the duct 254 as uniform as possible. It is evident that as the flow approaches the outlet 256 of the nozzle, the radius of curvature of the bend must increase. If a major change in direction is to occur, it is therefore preferable that the bend or change in direction should occur toward the duct inlet 254 where the fluid velocity is lowest rather than at the outlet 256 where the fluid velocity is at a maximum. In a vertical inlet device, the exit angle of the fluid from the outlet 256 is provided such that the axial component of the fluid's velocity matches the axial component of the flow in the separator body. In many applications, particularly where the feedstream has a viscosity like that of water, an exit angle of about 4° is adequate.

Figure 15:
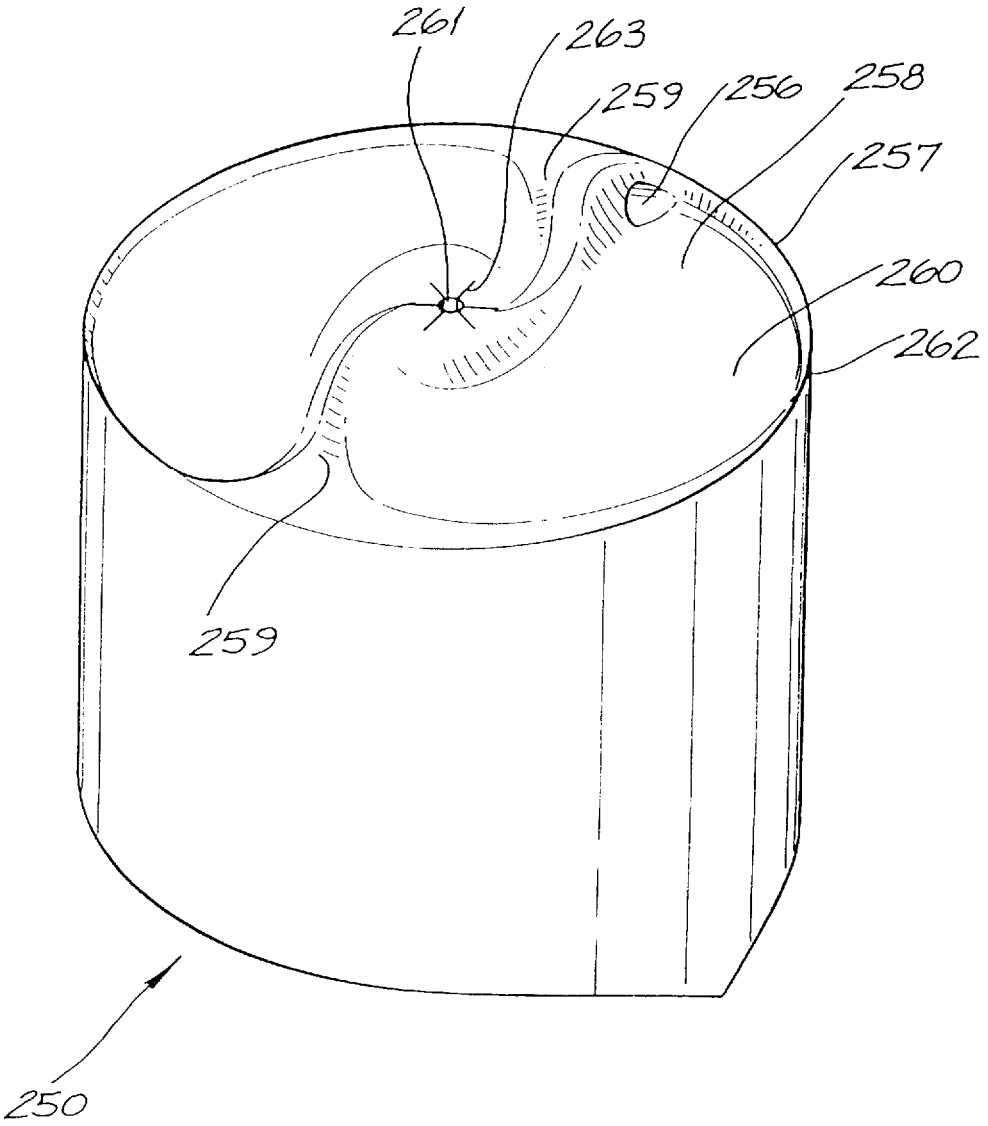
FIG. 15 is a perspective view (inverted) illustrating the bottom of the inlet depicted in FIGS. 13 and 14.

As shown in FIG. 15, the bottom surface 260 may be contoured to minimise losses associated with the introduction of the fluid into the separator body. Taking into consideration that the inlet 250 is being viewed from the underside in FIG. 15, it will be appreciated that the outlet 256 is located as close as practical to the outside diameter 257 of the inlet 250. The surface 258 surrounding the outlet 256 blends smoothly from the perimeter of the outlet 256 in the direction of the liquid flow. The lower surface of the pocket or depression in which the outlet 256 lies blends smoothly toward the extremity 259 which lies below the other outlet 256 (above in this inverted view). The radially inward portion of the pocket or depression blends toward the discharge orifice 261 and the radially outward portion of this same surface blends toward the outside diameter 262. In preferred embodiments, the inlet structure 250 would include the flexible diaphragm or flexible sectors 263 discussed with reference to FIGS. 1 and 2. In every preferred embodiment, the centre of the duct inlet 254 and the outlet 256 are spaced apart from one another (radial sweep) by less than one fall revolution or 360°. In most preferred embodiments, this separation is less than ⅓ a revolution. In some preferred embodiments this separation is equal to or less than ¼ of a revolution.

As shown in FIG. 2, a polymeric inlet nozzle structure 1 may incorporate a thin layer of ceramic particles 300. With regard to the example depicted in FIG. 2, the inlet 1 may be fabricated from cast polyurethane. A quantity of pre-cleaned 1 mm ceramic beads may be incorporated into the casting compound and the bottom of the device cast first. The remainder of the device is then cast on top, this later addition will bond securely with the first layer containing the ceramic particles. The ceramic particles improve the abrasion resistance of the lower surface 301, which surface appears to be the one most susceptible to abrasive wear. In the alternative the entire device may be cast from the ceramic particle-polymer composite referred to above.

Industrial Application

Suitable components to be separated using the cyclone separators disclosed herein include but are not limited to (dissolved) gases in solution, water, free gases, light or heavy solids, starches and solvents. These separators have particular applications in the separation of (1) oil from water produced in oil refining, oil products, nuclear power plants, power stations and in the mining, steel and shipping industry such as during bilge or ballast treatment; (2) solvents from water such as those produced during mineral extraction. Organic solvents are normally used in such applications; (3) light oils from citrus juices; (4) fatty substances from milk; (5) entrained gases from beverages, in particular those resulting in the manufacture of beer and liquid pharmaceutical preparations; (6) fibre particles from beverages; (7) wax from water especially that produced by the pulp and paper industry; (8) coal fines from bulk coal; and (9) solids that are oil wet in sewage. In addition, the cyclone separators of this invention can be used in desalting, i.e. the removal of oil from salt water during oil refining.

I claim:

1. A hydrocyclone axial feed inlet body for use with a hydrocyclone to separate feed material, said axial feed inlet body comprising an upper face, a lower face and a circumferential edge portion extending between the upper face and the lower face to define the body, said body being provided with at least one helical duct, said duct or each of said ducts extending substantially arcuately through the body from the upper face to the lower face about a central axis by less than 360°, each duct being provided with an inlet located in the upper face for receiving an axial flow of feed material and an outlet located in the lower face for discharging the feed material in a substantially tangential flow, said body further comprising an adjustable overflow orifice extending axially along a central longitudinal axis, wherein when the feed material passes through the axial feed inlet body the axial flow of feed material admitted to the inlet or inlets of the helical duct or ducts is transformed to emerge from the outlet or outlets of the helical duct or ducts tangentially or with a swirling, revolving spiral movement and wherein the overflow orifice is adjustable in size.

2. The feed inlet body of claim 1 wherein two ducts are provided, each duct being spaced from the other by 180°, each duct extending over a sweep of 180° or less.

3. The feed inlet body of claim 2 wherein each duct extends over a sweep of 120° or less.

4. The feed inlet body of claim 3 wherein each duct extends over a sweep of 90° or less.

5. The feed inlet body of claim 3 wherein each duct has a sweep of about 90°.

6. The feed inlet body of claim 1 in which the upper face is provided with a conduit extending from the upper face wherein the overflow orifice opens into the conduit.

7. The feed inlet body of claim 6 wherein the conduit further comprises at an upper extremity a tapered opening.

8. The feed inlet body of claim 1 wherein the size of the overflow orifice can be enlarged.

9. The feed inlet body of claim 1 wherein the overflow orifice is surrounded by a plurality of flexible sectors, which sectors may deform, thus changing the effective size of the overflow orifice.

10. The feed inlet body of claim 9 in which the sectors deform to enlarge the effective size of the overflow orifice.

11. The feed inlet body of claim 1 wherein a crescent shaped passageway leads into the or each helical duct, each crescent shaped passageway having a distal end and a proximal end wherein a bottom surface of each proximal end is co-incident with a bottom surface of the or each helical duct.

12. The feed inlet body of claim 6 which a circumferential step is provided within the duct or conduit adjacent the overflow orifice.

13. The feed inlet body of claim 1 wherein each duct is tapered by 6°–8°.

14. The feed inlet body of claim 1 made from a flexible polymeric material.

15. The feed inlet body of claim 9 in which the sectors are made from flexible polymers.

16. The feed inlet body of claim 6 in which the diameter of the conduit is greater than the diameter of the overflow orifice.

17. The feed inlet body of claim 6 in which a tapered rod is receivable in the conduit for altering the size of the overflow orifice, particularly increasing the size of the orifice to clear any blockages of the orifice.

18. The feed inlet body of claim 1 in which the overflow orifice is located in the wall forming the lower surface of the inlet body.

19. The feed inlet body of claim 1 wherein the outlet of the duct in the lower face is at a larger radius than the inlet of the duct in the upper face.

20. A hydrocyclone separator body comprising an axial feed inlet body for use with a hydrocyclone to separate feed material, said axial feed inlet body comprising an upper face, a lower face and a circumferential edge portion extending between the upper face and the lower face to define the body, said body being provided with at least one helical duct, said duct or each of said ducts extending substantially arcuately through the body from the upper face to the lower face about a central axis by less than 360°, each duct being provided with an inlet located in the upper face for receiving an axial flow of feed material and an outlet located in the lower face for discharging the feed material in a substantially tangential flow, said body further comprising an adjustable overflow orifice extending axially along a central longitudinal axis, wherein when the feed material passes through the axial feed inlet body the axial flow of feed material admitted to the inlet or inlets of the helical duct or ducts is transformed to emerge from the outlet or outlets of the helical duct or ducts tangentially or with a swirling, revolving spiral movement and wherein the overflow orifice is adjustable in size.

* * * * *